US005253391A

United States Patent [19]

Ojima

[11] Patent Number: 5,253,391

[45] Date of Patent: Oct. 19, 1993

[54] HINGE DEVICE

[75] Inventor: Juji Ojima, Aikawa, Japan

[73] Assignee: NHK Spring Co., Ltd., Kanagawa, Japan

[21] Appl. No.: 726,820

[22] Filed: Jul. 8, 1991

[30] Foreign Application Priority Data

Jul. 7, 1990 [JP] Japan ..... 2-179751

[51] Int. Cl.[5] ..... E05F 1/08; E05F 5/00

[52] U.S. Cl. ..... 16/289; 16/308

[58] Field of Search ..... 16/225, 280, 285, 299, 16/DIG. 13, DIG. 33, 289, 290, 386, 398, 308, 75, 291, 306; 220/264

[56] References Cited

U.S. PATENT DOCUMENTS

| | | | |
|---|---|---|---|
| 2,395,456 | 2/1946 | Bunker | 16/308 |
| 2,774,099 | 12/1956 | Thomas | 16/308 |
| 2,821,942 | 2/1958 | Goodwin | 16/289 |
| 2,908,050 | 10/1959 | Sullivan et al. | 16/308 |
| 2,987,332 | 6/1961 | Bonmartini | 16/225 |
| 3,022,536 | 2/1962 | Floehr | 16/308 |
| 3,146,847 | 9/1964 | Rutman et al. | 16/308 |
| 3,209,391 | 10/1965 | Mangini | 16/386 |
| 3,254,452 | 6/1966 | Costantini et al. | 16/308 |
| 3,787,923 | 1/1974 | Peterson | 16/308 |
| 4,571,775 | 2/1986 | Leonard | 16/298 |
| 4,944,481 | 7/1990 | Yurchenco et al. | 16/308 |

FOREIGN PATENT DOCUMENTS

| | | | |
|---|---|---|---|
| 3313220 | 10/1984 | Fed. Rep. of Germany | 16/75 |
| 2-178480 | 7/1990 | Japan | 16/308 |

*Primary Examiner*—John Sipos
*Assistant Examiner*—Donald M. Gurley
*Attorney, Agent, or Firm*—Keck, Mahin & Cate

[57] ABSTRACT

A hinged device includes a stationary component hinged with a rotatable component by means of a damper element wherein a lid shaped rotatable component is opened or closed at a low speed by means of a torsion bar connecting the stationary component and the rotatable component, and high viscosity grease is filled in gaps between bearings and small diameter shaft portions of the hinge.

8 Claims, 5 Drawing Sheets

HINGE DEVICE

BACKGROUND OF THE INVENTION

The present invention relates to a hinge device having a torsion bar with which a rotatable component is connected to a stationary component.

This type of hinge device is used on a compact, stool, car dashboard or the like, of which lids are rotatable components. The rotatable components are energized to the opening direction with a torsion spring. One of this type of hinge device was disclosed in a Japanese Patent Application No. 63-331955 (Japanese Patent No. 2-178,480, Jul. 7, 1990 by the present applicant.

In FIGS. 9 and 10 showing a conventional hinge device, a rotatable component 1 opens and closes in relation to a stationary component 2. In this case, a rotation of the rotatable component is performed around a shaft element 3 comprising a stationary shaft 4, a rotatable shaft 5 and torsion bars 6 fastening between them, the stationary shaft 4 comprises a supporting portion 4*b* integrally connected to a shaft portion 4*a*. The shaft portion 4*a* is unrotatably inserted into the stationary component 2 and the supporting portion 4*b* is rotatably inserted into the rotatable component.

On the other hand, the rotatable shaft 5 comprises a connecting portion 5*b* having a plurality of serrations 5*a* on an outer surface thereof and a cylinder portion 5*c* coaxially formed on the opposite side of the connecting portion 5*b*, between which a flange portion 5*d* is formed. The connecting portion 5*b* with serrations 5*a* is fitted into the serrated inner wall of the rotatable component 1, then the rotatable shaft 5 is integrally connected to the rotatable component 1. Then, a cylinder portion 5*c* of the rotatable cylinder 5 is rotatably supported by a cylinder portion 7*a* of an adjusting shaft 7 fixed on the stationary component 2 by serrations 7*b* formed on an outer surface thereof.

Gaps between the cylinder portion 5*c* of the rotatable shaft 5 and the cylinder portion 7*a* are filled with high viscosity grease (not shown).

The rotatable component 1 is energized by the torsion bars 6 in the opening direction. However, the rotatable component 1 rotates at a low speed because of the high viscosity of grease.

The adjusting shaft 7 can be applied an initial torque by adjusting the rotatable shaft 5 as follows:

Firstly, the serration joint between the serrations 7*b* of the adjusting shaft 7 and the stationary component 2, and the other serration joint between the connecting portion 5*b* of the rotatable cylinder 5 and the rotatable component 1 are disengaged keeping the stationary shaft 4 partially inserted into the stationary component 2. Then, a new angular difference is made between the rotatable component 1 and the rotatable shaft 5 by engaging a dog clutch 5*e* and inserting the serrations 5*a* of the rotatable shaft 5 into different serrations of the rotatable component 1.

However, in the aforementioned conventional hinge device, it is necessary to have a process for forming the shaft element 3 by inserting both ends of the torsion bars 6 into the stationary shaft 4 and the rotatable shaft 5. Other processes are necessary to form the serrations on the rotatable component 1 and the stationary component 2 so that the rotatable shaft 5 and the adjusting shaft 7 are fitted into the rotatable component 1 and the stationary component 2 respectively. Accordingly, too many processes are needed.

After applying an initial torque on the torsion bars 6, the rotatable shaft 5 and the adjusting shaft 7 must be inserted into other angular position of serrations. However, it is not easy to insert the rotatable shaft 5 and the adjusting shaft 7 already tensioned by the torsion bars 6 into other angular position of serrations, because there is a light angular difference between the serrations.

Further, in the above conventional hinge device, both ends of the torsion bars 6 are fixed on the stationary shaft 4 and rotatable shaft 5 which reduced an effective length of the torsion bars 6. Therefore, in order to obtain an increased torsion, it is necessary to add a plurality of torsion bars and it causes an increase of weight.

In addition, in order to improve a damper effect thereof, it is necessary to extend the lengths of rotatable shaft 5 and adjusting shaft 7 in the axial direction, or to increase cylindrical portions of the both shafts 5 and 7, which are inserted alternately. In the former, the damper mechanism is formed on only one side, prejudicing a total balance. In the latter, it is difficult to apply on a small shock absorber, not permitting a free design of products.

BRIEF DESCRIPTION OF THE INVENTION

The present invention was developed taking the above situations into consideration and provides a hinge device, which is easy to be manufactured and assembled, permitting a free design of products.

The hinge device according to the present invention comprises a rotatable component 10 to be integrally fastened with lids or the like, a stationary component 20 to be integrally fastened with a stationary base or the like and a shaft element 30 to be inserted into both components so as to work as a pivot and as a torsional shock absorber. The rotatable component 10 has a pair of non-circular bearing portions on the left and right side thereof, having a non-circular inner hole and a non-circular outer surface thereon. The stationary component 20 has a protruded portion to be coaxially inserted between the bearing portions, having a non-circular inner hole and a non-circular outer surface. The shaft element 30 comprises a large non-circular diameter portion and a pair of small diameter portions on the both end thereof, having a through hole of cross section throughout the whole length, a torsion bar having hooks on the both ends thereof and inserted into the through hole, a pair of caps having a non-circular outer surface to be inserted into the bearing portions and a round inner hole to receive the small diameter portion, one of which bottom is formed a slot therein to receive the hook of the torsion bar and high viscosity grease filled in gaps between the small diameter portions and the inner holes of the caps.

A plurality of sealing components may be put between the caps and the ends of small diameter portions.

BRIEF DESCRIPTION OF THE DRAWINGS

FIG. 1(*b*) shows a partial sectional view along line b—b in FIG. 1(*a*). FIG. 1(*c*) shows a partial sectional view along line c—c in FIG. 1(*b*). FIG. 1(*d*) shows a partial sectional view along line d—d in FIG. 1(*b*). FIG. 3(*b*) shows a sectional view along line b—b in FIG. 3(*a*). FIG. 4(*b*) shows a sectional view along line b—b in FIG. 4(*a*). FIG. 4(*c*) shows a sectional view along line c—c in FIG. 4(*a*). FIG. 5(*b*) shows a sectional view along line b—b in FIG. 5(*a*). FIG. 8(*b*) shows a sectional view along line b—b in FIG. 8(*a*).

DETAILED DESCRIPTION OF THE PREFERRED EMBODIMENTS

Figure 1:
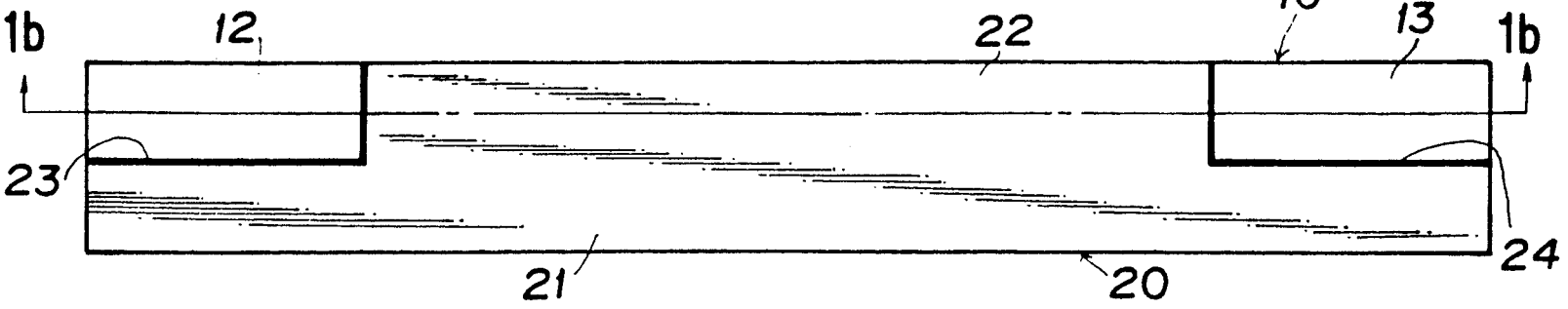
FIG. 1(*a*) shows a front view of an embodiment according to the present invention.
Figure 1:
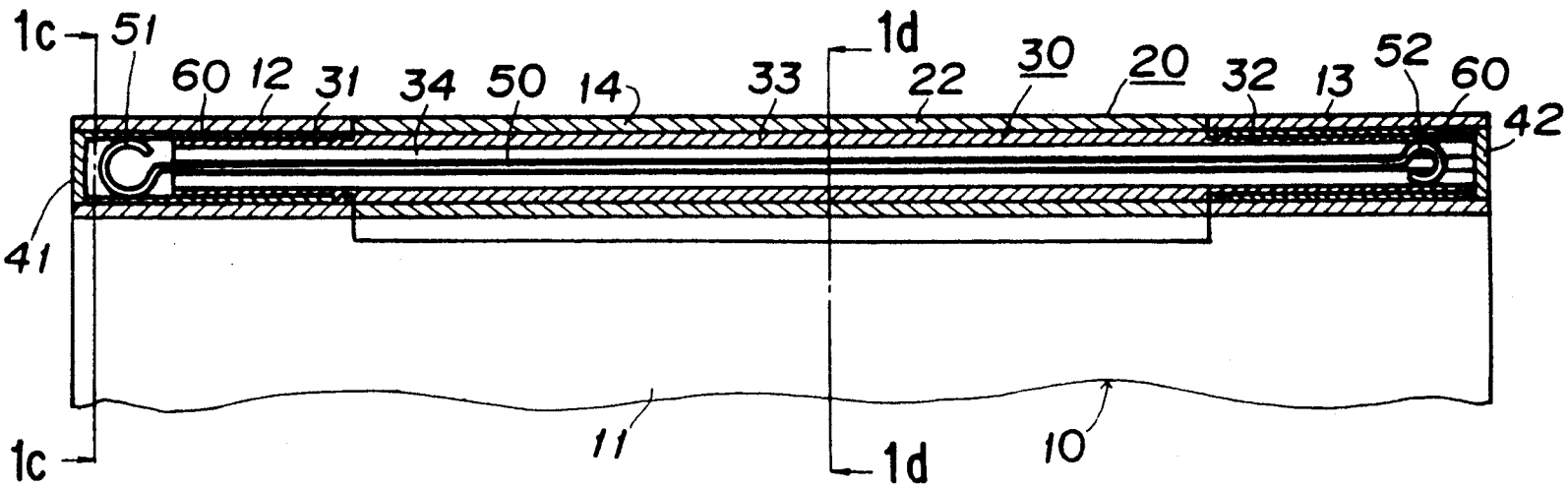
Figure 2:
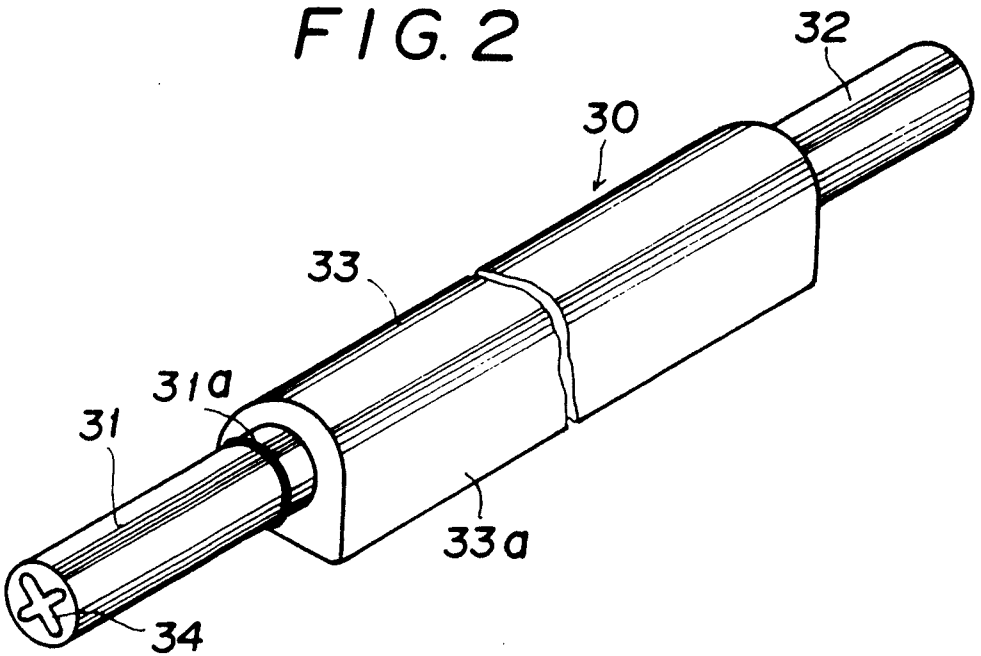
FIG. 2 shows a partial perspective view of shaft.
Figure 3A:
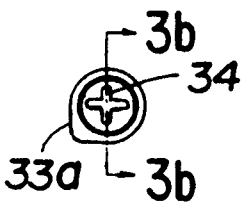
FIG. 3(*a*) shows an end view of the shaft in FIG. 3(*b*).
Figure 3B:
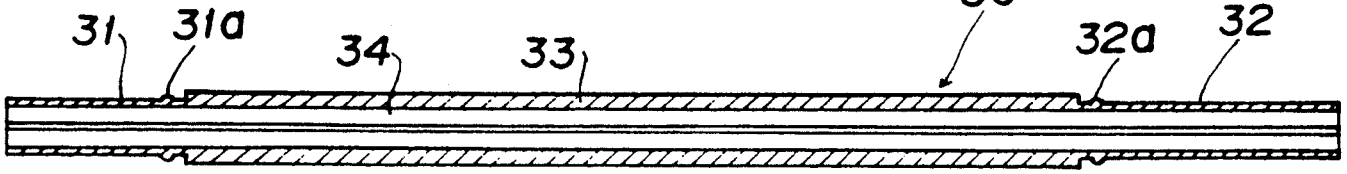
Figure 1C:
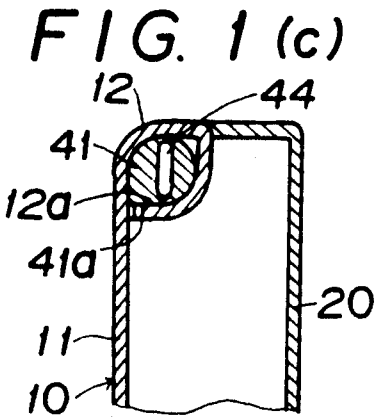
Figure 1D:
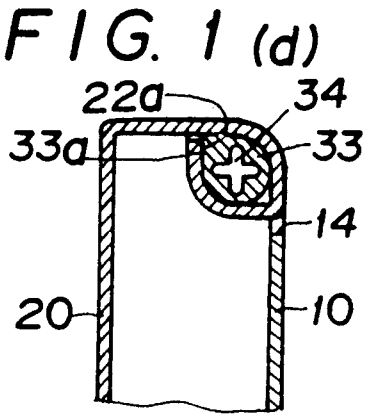

Hereinafter, the present invention will be described in detail referring to the drawings.

FIG. 1 shows an applied hinge device according to the present invention, wherein there are a rotatable component 10, a stationary component 20, a shaft element 30, caps 41 and 42, a torsion bar 50 and high viscosity grease 60.

The rotatable component 10 is made of sheet metal and has a rotatable body 11 and bearing portions 12 and 13 protruded on the both ends of the rotatable body 11. Between the bearing portions 12 and 13, there is a space 14 for mounting a protruded hinge portion 22 of the stationary component 20 {refer to FIG. 1 (*b*)}. The bearing portions 12 and 13 are formed in a non-circular form by a curling process as shown in FIG. 1(*c*), wherein there is a non-curled end 12*a*.

The stationary component 20 is made of sheet metal too and has a stationary body 21 and the protruded hinge portion 22 to be mounted between the bearing portions 12 and 13 abutting retreated ends 23 and 24 thereof onto the bearing portions 12 and 13. The protruded portion 22 is formed in a non-circular form by a curling process as shown in FIG. 1(*d*).

The shaft element 30 has a through hole 34 therein and has a large diameter portion 33 and two small diameter portions 31 and 32 coaxially located on the both ends of large diameter portion 33. The large diameter portion 33 has a flat surface 33*a*. The shaft element 30 is made of, for example, synthetic resin by an injection process. The through hole 34 may be a groove, but in this embodiment a through hole having a cross section is formed considering a mechanical resistance of a core used in the process. Further, there are ring ribs 31*a* and 32*a* to be inserted rotatably into the caps 41 and 42.

Figure 4:
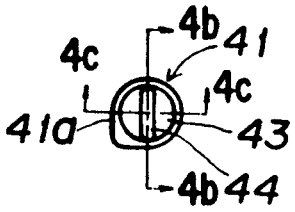
FIG. 4(*a*) shows an end view of a cap.
Figure 4:
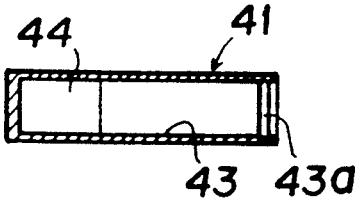
Figure 4:
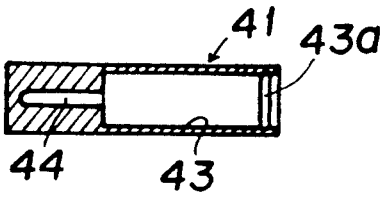

As shown in FIGS. 4(*a*), 4(*b*) and 4(*c*) the cap 41 is of closed tube form having a round hole therein and a non-circular outer surface with a flat portion 41*a*. A slot 44 is formed in a bottom thereof and an inner ring groove 43*a* is formed on the inner wall thereof 43 in the proximity of opening end. The cap 41 can be inserted externally and rotatably on the small diameter portion 31 and retained by the ring groove 43*a* and the ring rib 31.

Figure 5:
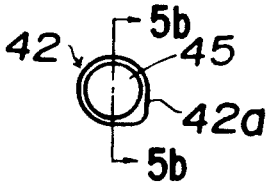
FIG. 5(*a*) shows an end view of another cap.
Figure 5:
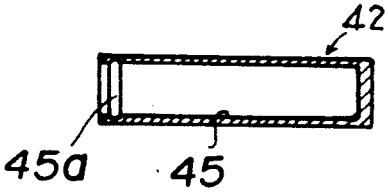

As shown in FIGS. 5(*a*) and 5(*b*) the cap 42 is of closed tube form having a round hole therein and a non-circular outer surface with a flat portion 42*a*. The cap 42 can be inserted externally and rotatably on the small diameter portion 32 and retained by an inner ring groove 45*a* formed on an inner wall thereof 45 in the proximity of opening end and the ring rib 32*a*.

The torsion bar 50 has a sufficient length covering the distance between the both bearing portions 12 and 13, and has a smaller hook 52 and a larger hook 51 on the ends thereof. The larger hook 51 can be inserted into the slot 44 of the cap 41 and the smaller hook 52 can be inserted into the through hole 34 of the shaft element 30.

The shaft element 30, the caps 41 and 42, and the torsion bar 50 can be previously assembled as a subassembly.

Firstly, the cap 42 is put on the small diameter portion 32 and the smaller hook 52 is inserted into the end of the through hole 34 and then, the larger hook 51 still sticks out of other small diameter portion 31. The cap 41 is put on the small diameter portion 31 inserting the larger hook 51 into the slot 44 and retained by the ring rib 31*a* and the ring groove 43*a*. Then, the caps 41 and 42 are rotatable on the small diameter portions 31 and 32.

The shaft element 30 is mounted on the rotatable component 10 and the stationary component 20 as follows:

The protruded portion 22 of the stationary component is coaxially positioned between the bearing portions 12 and 13 and the cap 42 of the shaft element 30 is inserted into the bearing portion 13 through the bearing portion 12. Then, the caps 41 and 42 are fixed on the bearing portions 12 and 13 by means of the flat portions 41*a* and 42*a* respectively. A flat portion 33*a* of the large diameter portion 33 abuts on a flat portion 22*a* of the protruded portion 22 and the rotation of the large diameter portion 33 is restrained. Then, the shaft element is fixed on the stationary component 20 and the caps 41 and 42 are fixed on the rotatable component 10. The rotation of the rotatable component 10 is excuted by the torsional force of the torsion bar 50. Then, the high viscosity grease 60 filled in a gap between the cap 41 and the small diameter portion 31, and between the cap 42 and the small diameter portion 32 works to rotate the rotatable component 10 at a low speed.

In order to energize the rotatable component 10 with the torsion bar 50 into the opening direction, the following procedure is taken:

The rotatable component 10 is positioned on the stationary component keeping the rotatable component fully opened and the shaft element 30 is inserted into the bearings. When the rotatable component 10 is closed, the cap 41 rotates, accordingly the larger hook 51 of the torsion bar 50 rotates.

Then, the torsion bar 50 is twisted by the rotation of the larger hook 51 and a torsional energy is stored on the torsion bar 50 in the opening direction. The torsional energy reaches the maximum value when closed. The rotatable component 10 moves in the opening direction when a lock is released.

An initial torque can be applied on the torsion bar 50 as follows:

When the shaft element 30 is inserted into the bearings through the rotatable component 10, the torsion bar 50 is twisted by turning the cap 41 after locking the rotation of the shaft element 30 by inserting the large diameter portion 33 of the shaft element 30 a little into the protruded portion 22 of the stationary component 20. Then, the shaft element 30 is pushed in keeping the same torsional angle of the torsion bar 50 and the caps 41 and 42, and the large diameter portion 33 of the shaft element 30 are fastened onto the bearing portions 12 and 13 of the rotatable component 10 and the protruded portion 22 of the stationary component 20.

In this manner, an initial torque can be applied on the torsion bar 50, of which value can be chosen by changing an angular rotation of the cap 41.

Figure 6:
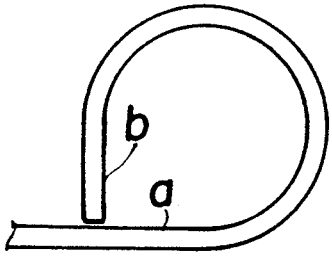
FIGS. 6(*a*), (*b*), (*c*) and (*d*) show bearings of rotatable component and bearings of stationary component.
Figure 6:
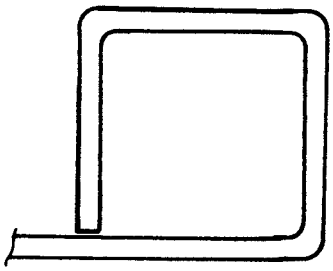
Figure 6:
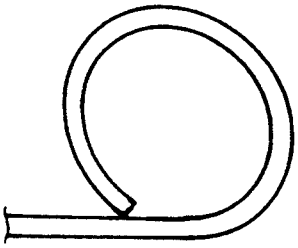
Figure 6:
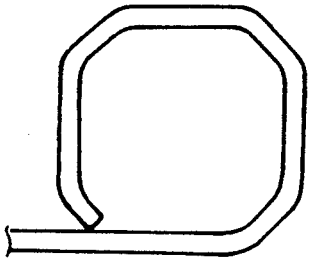

In FIGS. 6(*a*), (*b*), (*c*) and (*d*), other embodiments of bearing portion of a rotatable component 10 and protruded portion of a stationary component 20 are shown. FIG. 6(*a*) shows a curled form with flat portions "a" and "b". FIG. 6(*b*) shows a quadrangular form. FIGS. 6(*c*) and (*d*) show other variations. In these cases, the caps and the large diameter portion of shaft element can be assembled on the bearing portions of the rotatable component and the protruded portion of the stationary component so as to restrain a rotation thereof.

Figure 7:
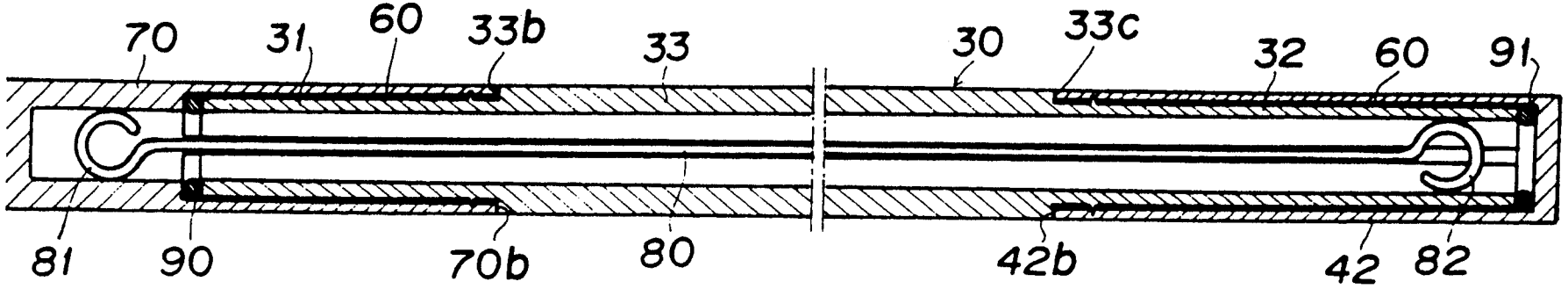
FIG. 7 shows an amplified sectional view of hinge device.
Figure 8:
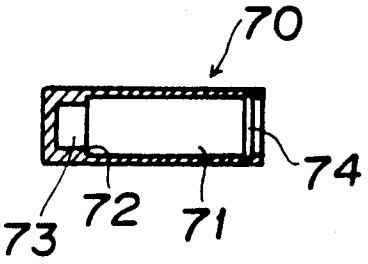
FIG. 8(*a*) shows a sectional view of cap.
Figure 8:
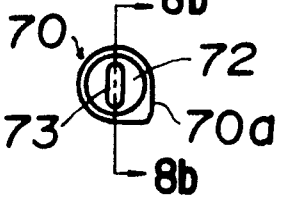
Figure 9:
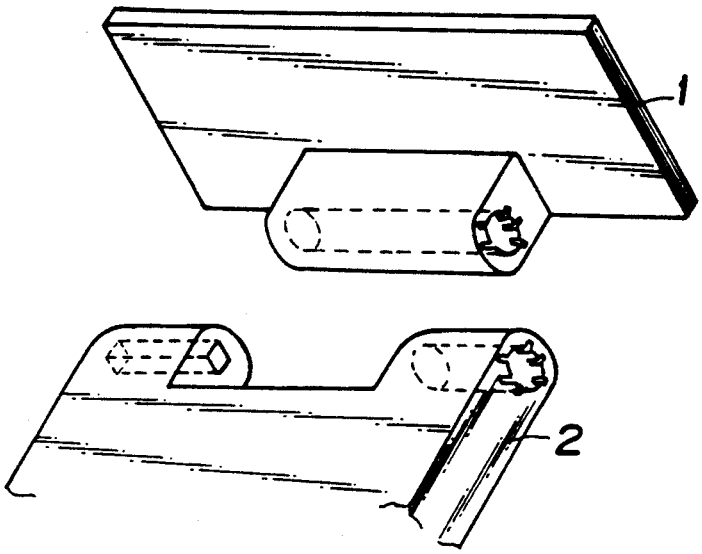
FIG. 9 PRIOR ART
FIG. 9 shows a perspective view of a conventional hinge device.
Figure 10:
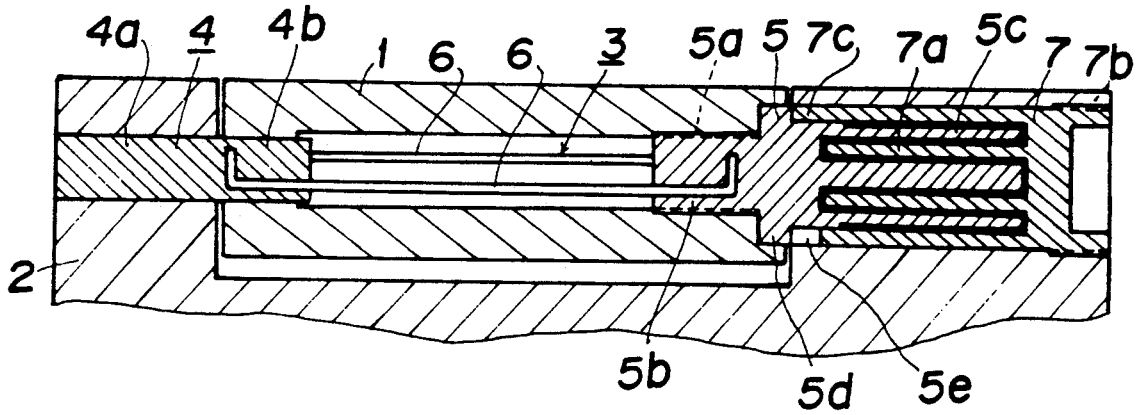
FIG. 10 PRIOR ART
FIG. 10 shows a vertical sectional view of hinge device of FIG. 9.

In FIG. 7, another embodiment of hinge device is shown, wherein a cap 70 and a torsion bar 80 are used in the place of cap 41 and torsion bar 50 in the former embodiment. A pair of sealing components 90 and 91 are added. Accordingly, those numerals used on the former embodiment are used in this case and the same descriptions used therein are omitted. The tube shaped cap 70 has a flat portion 70*a* on the outer surface and a cylinder portion 71 as shown in FIG. 8 so as to be inserted into the bearing portion 12 of the rotatable component 10. A slot 73 is formed on the closed end thereof. The cap 70 can be put externally and rotatably on the small diameter portion 31 of the shaft element 30. The slot 73 is of the same dimension as the pass through hole 34 of the shaft element 30. Numeral 74 indicates an inner ring groove to be engaged with the ring rib 31*a* of the small diameter portion 31.

The torsion bar 80 has a pair of hooks 81 and 82 of same dimension on both ends, which are inserted into the through hole 34.

Further, the sealing components 90 and 91 are formed in almost "O" ring shape corresponding to the section of small diameter portions 31 and 32. Then, "O" rings or elastic packings made of rubber or synthetic resin are used.

The hinge device to the present embodiment is assembled as follows:

Firstly, the torsion bar 80 is inserted easily into the through hole 34 of the shaft element 30. Then, the hook 82 is inserted into the through hole 34 and the other hook 81 stays out of the small diameter portion 31. The both small diameter portions 31 and 32 are applied high viscosity grease and the caps 70 and 42 are put on together with the sealing components 90 and 91. As shown in FIG. 7, gaps between the cap 70 and the small diameter portion 31 and between the cap 42 and the small diameter portion 32 are sealed with the sealing components 90 and 91.

Further, even if there is some dimensional differences between the shaft element 30 and the caps 70 and 42, the differences may be compensated by the sealing components 90 and 91.

In addition, other sealing components (not shown) may be used between step portions 33*b* and 33*c* of the shaft element 30, and end portions 70*b* and 42*b* so as to obtain better sealing effect than the aforementioned embodiments.

According to the aforementioned embodiments, it is not necessary to form the shaft element by connecting the rotatable component and the stationary component. The torsion bar is directly inserted into the shaft element and the both ends thereof are connected to the components dispensing an additional forming process of torsion bar. A torsion bar with a large effective length can be used to obtain a large torsional force.

A damper system according to the present invention comprises caps put on the both ends of shock absorber and high viscosity grease filled in gaps between the caps and the shaft element. Therefore, even though the gaps to be filled with high viscosity grease are extended in longitudinal direction, the damper effect can be improved without prejudicing an appearance thereof and it provides a hinge device permitting free design.

Further, the outer surfaces of the central portion of the shaft element and the caps are formed in non-circular form and these parts are assembled easily by only inserting it into non-circular holes formed in the rotatable component and the stationary component. The above non-circular holes are formed easily by a curling process of sheet metal.

An improved damper effect is obtained by locating sealing components between the caps and the shaft element.

What is claimed is:

1. A hinged device comprising:

a stationary component integrally fastened to a base, a rotatable component, pivotally supported by said stationary component, integrally fastened to a lid of said base, and a damper element inserted into both said components, wherein said damper element comprises:

a shaft, having a center portion fastened to one of said stationary component and said rotatable component and two end portions pivotally supporting the other of said components, and a through hole extending longitudinally through said shaft, caps positioned on respective end portions of said shaft fastened to one of said stationary component and said rotatable component, a torsion bar bridging said components through said shaft extending along said through hole, a first end of said torsion bar retained in a slot in said one of said caps fastened to said non-rotatable component and a second end of said torsion bar retained in said through hole of said shaft, wherein torque is developed when said rotatable component is rotated, and viscous grease sealed between said shaft and said caps to dampen pivotal movement of the rotatable component caused by the torsion bar.

2. A hinged device according to claim 1 wherein said rotatable component comprises:

a pair of non-circular bearing portions formed on left and right ends thereof and having a non-circular inner hole.

3. A hinged device according to claim 2 wherein said stationary component comprises:

a protruding portion having a non-circular through hole non-rotatably receiving said shaft therein and coaxially inserted between said pair of bearing portions.

4. A hinged device according to claim 3 wherein said shaft comprises:

a non-circular large diameter portion of said center portion wherein said through hole is of cross-shaped section and said shaft being unrotatably inserted into said non-circular through hole of said stationary component;

a pair of small diameter portions coaxially extended from both ends of said large diameter portion and having a continuation of said cross-shaped through hole therein, a pair of ring ribs formed on an outer surface of the small diameter portions thereof adjacent to said large diameter portion;

a first of said caps positioned on one of said small diameter portions comprising a slot formed coaxially on a closed end thereof, a non-circular outer surface inserted into one of said bearing portions and an inner ring groove formed in a position corresponding to a first of said ring ribs;

a second of said caps positioned on the other of said small diameter portions comprising a closed end, a non-circular outer surface inserted into the other of said bearing portions and an inner ring groove formed in a position corresponding to a second of said ring ribs;

said torsion bar comprising a large hook and a small hook, and inserted within and between said closed end of said second cap and said slot of said first cap to connect said rotatable component and said stationary component, wherein said large hook is inserted into said slot and said small hook is inserted into said through hole of cross-shaped section; and said viscous grease comprises a high viscosity grease applied in gaps between said outer surfaces of said small diameter portions and said inner walls of said first and second caps.

5. A hinged device according to claim 2 wherein said non-circular inner hole comprises a round section with partial flat portion, an oval section, a quadrangular section or octagonal section.

6. A hinged device according to claim 3 wherein said non-circular inner hole comprises a round section with partial flat portion, an oval section, a quadrangular section or octagonal section.

7. A hinged device according to claim 4 wherein said high viscosity grease is sealed with "O" rings inserted into gaps between a step portion of said inner wall of said first cap and an end of one said small diameter portion, and between said closed end of said second cap and an end of the other said small diameter portion.

8. A hinged device according to claim 1 wherein said shaft comprises:

a non-circular large diameter portion of said center portion wherein said hole is of cross-shaped section and unrotatably inserted into a non-circular through hole of said stationary component;

a pair of small diameter portions coaxially extended from both ends of said large diameter portion and having a continuation of said cross-shaped through hole therein, wherein a pair of ring ribs are formed on an outer surface thereof adjacent to said large diameter portion;

a first of said caps on one of said small diameter portions comprising a slot forming coaxially on a closed end thereof, a non-circular outer surface inserted into a first bearing portion and an inner ring groove formed in a position corresponding to a first of said ring ribs;

a second of said caps on the other of said small diameter portions comprising a closed end, a non-circular outer surface inserted into a second bearing portion and an inner ring groove formed in a position corresponding to a second of said ring ribs;

said torsion bar comprising a pair of hooks, and inserted within and between said closed end of said second cap and said slot of said first cap to connect said rotatable component and said stationary component, wherein a first of said hooks is inserted into said slot and a second of said hooks is inserted into said through hole of cross-shaped section; and said viscous grease comprises a high viscosity grease applied in gaps between said outer surfaces of said small diameter portions and inner walls of said first and second caps, wherein said first and second hooks of said torsion bar are equal in size and said torsion bar connects said rotatable component and said stationary component.

* * * * *